US008827274B2

(12) United States Patent
Lamothe

(10) Patent No.: US 8,827,274 B2
(45) Date of Patent: Sep. 9, 2014

(54) PROJECTILE CONTAINMENT SYSTEM

(75) Inventor: Richard P. Lamothe, Burlington, CT (US)

(73) Assignee: Bullet Trap, LLC, Burlington, CT (US)

( * ) Notice: Subject to any disclaimer, the term of this patent is extended or adjusted under 35 U.S.C. 154(b) by 173 days.

(21) Appl. No.: 13/475,511

(22) Filed: May 18, 2012

(65) Prior Publication Data

US 2013/0307218 A1 Nov. 21, 2013

(51) Int. Cl.
*F41J 13/00* (2009.01)

(52) U.S. Cl.
USPC ..... 273/410

(58) Field of Classification Search
CPC ..... F41J 13/00; F41J 11/02; F41J 1/00; F41J 1/08; F41J 1/10; F41J 13/02
USPC ..... 273/403–410
See application file for complete search history.

(56) References Cited

U.S. PATENT DOCUMENTS

| | | | | |
|---|---|---|---|---|
| 1,992,001 | A * | 2/1935 | Caswell | 273/410 |
| 5,040,802 | A * | 8/1991 | Wojcinski et al. | 273/410 |
| 5,456,155 | A * | 10/1995 | Myrtoglou | 273/410 |
| 5,718,434 | A * | 2/1998 | Alward | 273/410 |
| 5,749,177 | A * | 5/1998 | Pontus et al. | 52/79.1 |
| 5,822,936 | A * | 10/1998 | Bateman | 52/281 |
| 7,793,937 | B2 | 9/2010 | Bateman et al. | |
| 8,469,364 | B2 * | 6/2013 | Bassett et al. | 273/410 |
| 8,602,418 | B1 * | 12/2013 | Hering et al. | 273/410 |
| 2010/0276889 | A1 * | 11/2010 | Bateman et al. | 273/410 |
| 2012/0126480 | A1 * | 5/2012 | Bassett et al. | 273/410 |

OTHER PUBLICATIONS

Meggitt Training Systems brochure "5000E Steel Rifle Trap" from www.meggitttrainingsystems.com (2 pages).

* cited by examiner

*Primary Examiner* — Mark Graham
(74) *Attorney, Agent, or Firm* — McCormick, Paulding & Huber LLP

(57) ABSTRACT

Steel plates loosely mounted in frame, with neoprene pads between the frame and plates to better absorb the noise and impact from projectiles. The plates are inclined having laterally projecting tabs in openings defined by parallel steel side-walls. A containment chamber communicates with downstream ends of inclined plates by a transition area downstream of the inclined plates. Chamber has projectile impact boundary defined by laterally extending vanes or strips of hardened steel. End portions of vanes fit loosely in openings defined by the chamber side-walls. The vanes have beveled edges that abut one another so movement of adjacent vanes occurs in response to one of these vanes being struck by a projectile. Vanes are biased inwardly toward normal, or rest positions, but can move outwardly when impacted by a projectile. The number of vanes selected to establish angles of incidence for adjacent vanes less than 12 degrees in chamber.

25 Claims, 6 Drawing Sheets

PROJECTILE CONTAINMENT SYSTEM

FIELD OF INVENTION

This invention relates to projectile containment systems such as might be required at firing ranges or the like, and deals more particularly with a bullet trap of the type having an open front end in which a target can be provided and a steel structure for decelerating these projectiles and containing the projectiles fired at that target by a shooter located at a station some distance from the target. Such bullet traps are generally made from steel plates that are welded or bolted together in a structure that can include converging upper and lower plates defining a convergent passageway that directs the projectiles from the target area into a containment chamber where they are collected for disposal.

PRIOR ART

Bullet traps of such steel plate construction are available from Megitt Training Systems of Suwanee Ga., and from Action Target of Provo Utah. These bullet traps typically have upper and lower converging steel plates that direct the projectiles into an impact area so arranged as to abruptly decelerate the projectiles and contain them in a chamber. This chamber can be of generally semi-cylindrical shape, with a bottom opening and a tray for reclaiming the lead and other spent materials. U.S. Pat. No. 7,793,937 shows a trap of this variety, wherein a semi cylindrical impact area of the chamber is defined by replaceable hardened steel strips that are supported on flanges in the frame structure. One major disadvantage of this design is the very rigidity of the steel structure itself. Hardened steel, such as AR500 for example, tends to wear away, and become pitted, by the impact of the lead projectiles, leading to the need for replacement of the hardened steel strips. AR500 steel is not readily welded or machined by conventional heat generating fabrication processes.

Thus, there is a need for improving upon the design for such bullet traps, particularly, in the cost of manufacturing the hardened steel components, and in reducing the downtime and the expense required for removing and replacing the hardened steel strips that form the semi-circular impact region of the containment chamber.

The need for reducing the fabricating costs for the hardened steel used in these bullet traps has lead to excessive costs in both initial purchase of such traps, and in the upkeep thereof. Hardened steel, such as AR500, is not readily welded or machined, hence anything that can be done to reduce the fabrication costs will result in savings to both the manufacturer, and to the user in the form of reduced repair and maintenance costs.

SUMMARY OF THE INVENTION

The very rigidity of the steel frame, and of the hardened steel components from which the trap components are made, particularly in the impact area, which may have one or more angled hardened steel plates arranged to slow projectiles These plates are, therefore subject to wearing. There is a need to minimize this excessive wearing away and pitting of the hardened steel that results from the projectiles repeatedly striking the impact area of the trap.

The present invention provides a hardened steel containment chamber capable of absorbing the energy and momentum of high speed projectiles in an energy efficient way, and without the shock and noise characteristic of prior art bullet traps. The impact area, or boundary, of the containment chamber is defined by laterally extending projectile turning vanes, or strips, that have overlapping beveled edges. Rather than being rigidly mounted these vanes more efficiently absorb projectile impact as a result of providing each hardened steel strip, or vane, in an oversize opening of the steel support structure. More particularly, projecting end portions of these vanes are received in openings of slightly greater depth than the thickness of the vane end portions. The vanes are mounted in overlapping relationship, such that the beveled edges interact causing each vane to effect an adjacent vane when struck by a projectile. As a result, at least two vanes move slightly in reaction to one vane being impacted. The impact of the projectiles on these vanes is thereby absorbed more efficiently. A resilient elastomeric blanket is provided around the outside of the these containment chamber defining vanes, and the blanket is biased radially inwardly, holding the vanes against the inside edges of their respective openings. The beveled vane edges are thus held in engagement with one another, at least in their rest or ready positions, and will be displaced slightly in their respective openings in reacting to the impact and momentum of the projectiles, efficiently absorbing the energy thereof. The vanes are biased inwardly by tensionable straps surrounding the elastomeric blanket. Allowing the vanes to move upon impact also reduces damage to these hardened steel vanes. The biasing force is achieved by wrapping at least one tensionable band or strap at least the impact area of the containment chamber.

Another advantage to this unique yieldable vane mounting design is the reduction in the ambient noise levels. Reducing the impact forces, between the hardened steel vanes and the lead projectiles, leads to a very significant reduction in the ambient noise level at a firing range. This is a very important result, where the noise can create severe environmental concerns.

In accordance with a preferred embodiment of the invention, a convergent auxiliary entry passageway is also provided below the convergent projectile passageway described previously. This auxiliary passageway accommodates projectiles passing below the target area at the entry to the main convergent passageway, where the target is mounted. The area, below the containment chamber is rendered safer, and can, therefore, accommodate equipment associated with bullet traps, namely air evacuation and filtering equipment for removal of debris and gasses from the containment chamber. Such air handling equipment would otherwise be subject to damage from errant projectiles that are fired below the target. To define this auxiliary passageway an auxiliary plate cooperates with the underside of the lower convergent passageway plate to define this auxiliary convergent passageway. As so arranged errant projectiles are directed upwardly toward an auxiliary slot in a transition area between an auxiliary throat area at the downstream end of the main convergent passageway, and the containment chamber itself. The upper boundary of this transition area is preferably defined by vanes or strips of hardened steel, similar to those defining the impact area of the containment chamber. The lower boundary of this transition area, or zone, has an auxiliary slot or throat area for this auxiliary convergent passageway, and errant projectiles pass through said auxiliary slot into the containment chamber. The transition area vanes are also mounted in oversize openings and held in by the same, or similar to, the biased blanket described previously, the blanket being biased inwardly to act on these vanes in a manner similar to that of the vanes defining the impact boundary of the containment chamber.

DETAILED DESCRIPTION OF PREFERRED EMBODIMENT

Figure 1:
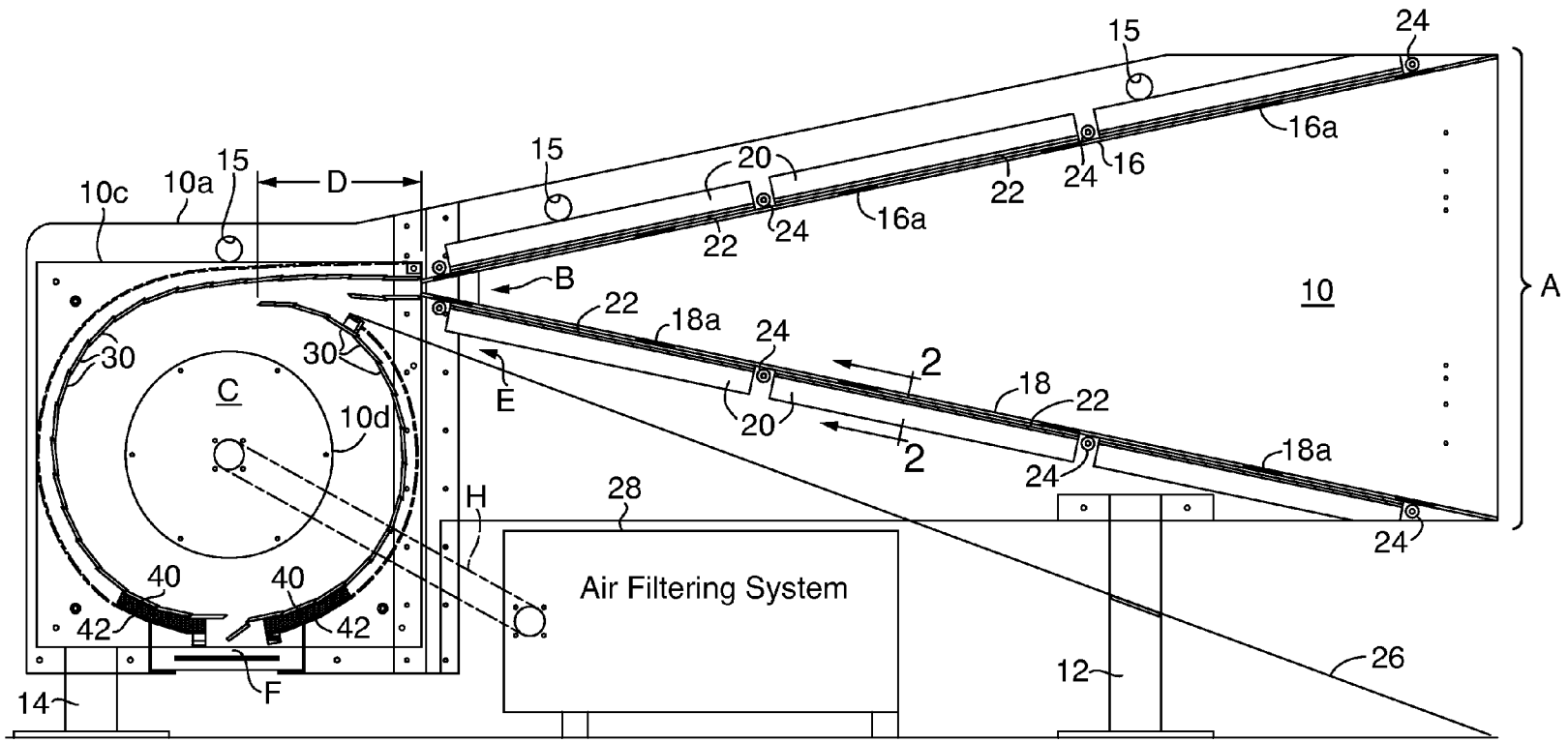
FIG. 1 is a side elevational view of a bullet trap constructed in accordance with the present invention.

In it's presently preferred form the bullet trap shown in the drawings will accommodate a single shooter located some distance upstream of the bullet trap. This distance will be dictated mostly by safety considerations, but will also be dictated by the type of firearm used, and by the immediate environment for the shooter's location relative to the bullet trap.

The bullet trap of FIG. 1 has an open front end A in which a target can be hung, and into which open end the projectiles are fired by the shooter. More particularly, the rectangularly shaped target opening A of the bullet trap has lateral sides, defined by spaced apart vertically extending steel plates 10,10, that are part of a frame which also includes other structural components, such as the legs 12 and 14. These side plates 10,10 are parallel so as not to interfere with projectiles fired into the bullet trap target opening from the shooter's station located upstream thereof. The edges of the target area A are preferably beveled inwardly for the same reason. Holes 15,15 in these side plates 10,10 are provided for receiving bungee cords, preferably of poly-urethane, to mount the target in the area A, and non-metallic "clothespins" may be used to clip the target to these cords.

The top and bottom sides of the rectangular target opening A are defined by forwardly facing upper and lower edges of inclined plates, 16 and 18. These plates are preferably made from hardened steel, and oriented at 15 degrees or less relative to the generally horizontal direction of normal fire from the shooter's station into the target opening A.

Angle irons or brackets, 20,20 are bolted or welded to the steel side support plates 10,10 or otherwise secured to a frame, such as that formed by these side plates. The inclined upper and lower hardened steel plates 16 and 18 provide a convergent passageway for the projectiles fired into the target area A.

Figure 2:
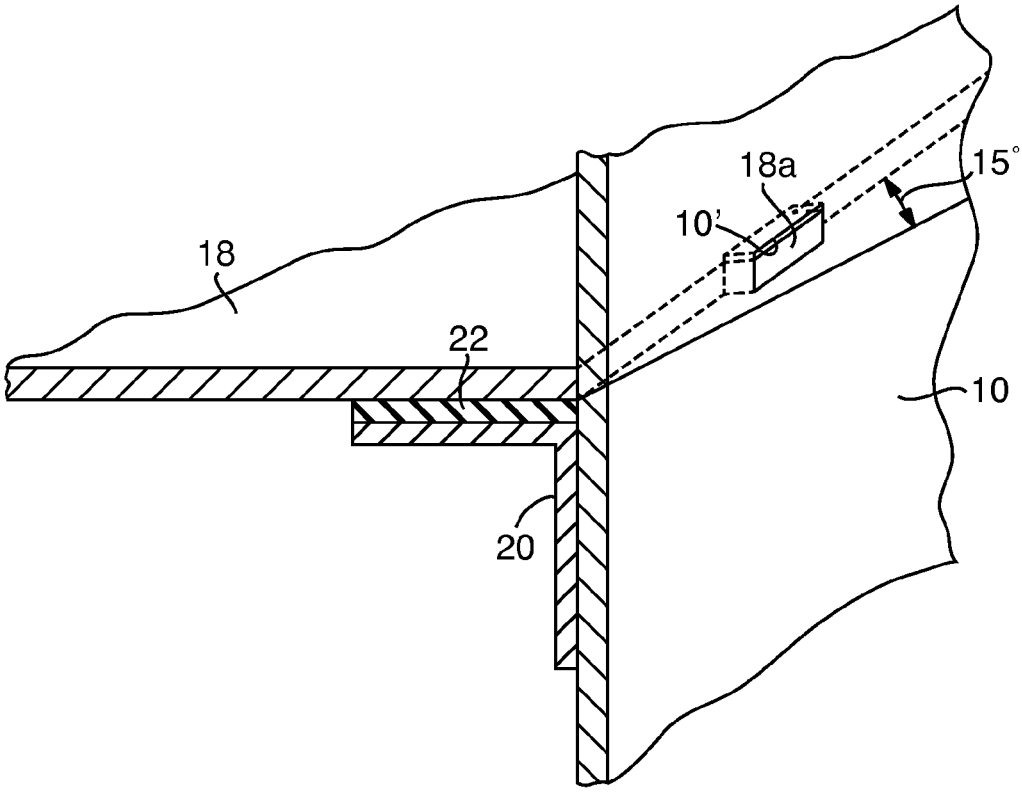
FIG. 2 is a sectional view taken on the line 2-2 in FIG. 1.

In the detailed sectional view of FIG. 2, taken on the line 2-2 of FIG. 1, the details of this support for these inclined plates can be seen to further include elastomeric buffer strips, 22, 22, preferably of neoprene or other inert, rubber-like material, provided between each inclined plate 16 and 18 and it's angle iron support bracket 20. Laterally outwardly projecting tabs 16*a* and 18*a*, are provided along the lateral edges of the hardened steel inclined plates, 16 and 18 respectively, being received in oversize openings 10',10' defined in the vertically oriented side support plates 10,10. These oversize openings allow at least limited up and down movement of the inclined plates relative to the fixed vertical support plates 10,10. This resilient mounting for the inclined plates better absorbs projectile impact, and reduces the noise otherwise created from such impact.

Still with reference to FIG. 1, horizontally extending tie rods 24,24 serve to hold the side plates 10,10 against the edges of the inclined plates 16 and 18, and allow the bullet trap to be readily assembled or disassembled for shipment or repair. If necessary neoprene might also be provided at the lateral edges of the inclined plates 16 and 18 in order to further reduce impact noise. Resiliently mounting these hardened steel plates reduces damage thereto, but more significantly, also reduces the ambient noise level.

The inclined plates define the open or target end A of a convergent passageway for the projectiles in which these projectiles are guided into a throat area B defined at downstream ends of the inclined plates 16 and 18.

A projectile containment chamber C is in communication with a transition passageway D provided between the throat area B and the containment chamber C. The lower boundary of this transition passageway D defines a downwardly open slot that is designed to entrain stray projectiles fired below the target opening A described above. More particularly, an auxiliary inclined plate 26 cooperates with the underside of the lower inclined plate 18 to define an auxiliary convergent passageway having an entry end below the target opening A. An auxiliary throat area E is defined below the throat area B for directing stray projectiles, that miss below the target area A, up into this auxiliary throat area E and through the transition area D into the containment chamber C.

Turning next to a detailed description of the containment chamber C, FIG. 1 shows vertically oriented side plate extensions 10*a*, 10*a* and chamber side walls, 10*c*, 10*c* bolted thereto. Each side wall defines a generally circular pattern of vane openings 10*b*, 10*b* for loosely receiving projections 30*a*, 30*a* on the opposed ends of vanes 30,30 that define the generally cylindrically shaped containment chamber C. This chamber C has at least one end wall 10*c* further defined by an access plate 10*d* to allow access to the chamber's interior. The access plate is preferably fitted with a hose H at center thereof for sucking out the lead laden air, and delivering this toxic air to an air filtration system 28 located behind the auxiliary plate 26.

Figure 3:
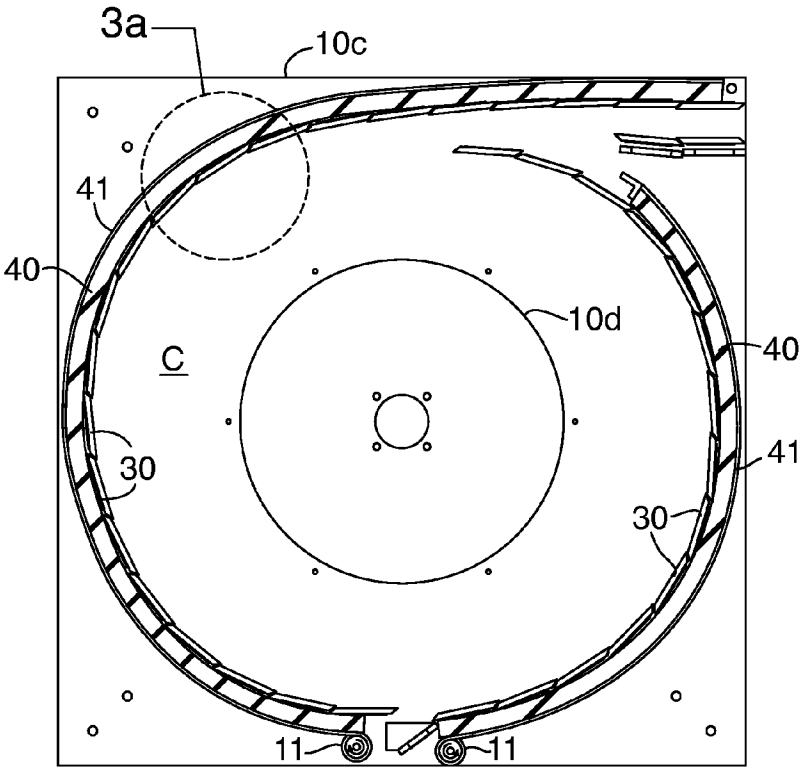
FIG. 3 is a sectional view showing details of the containment chamber depicted in FIG. 1.
Figure 4:
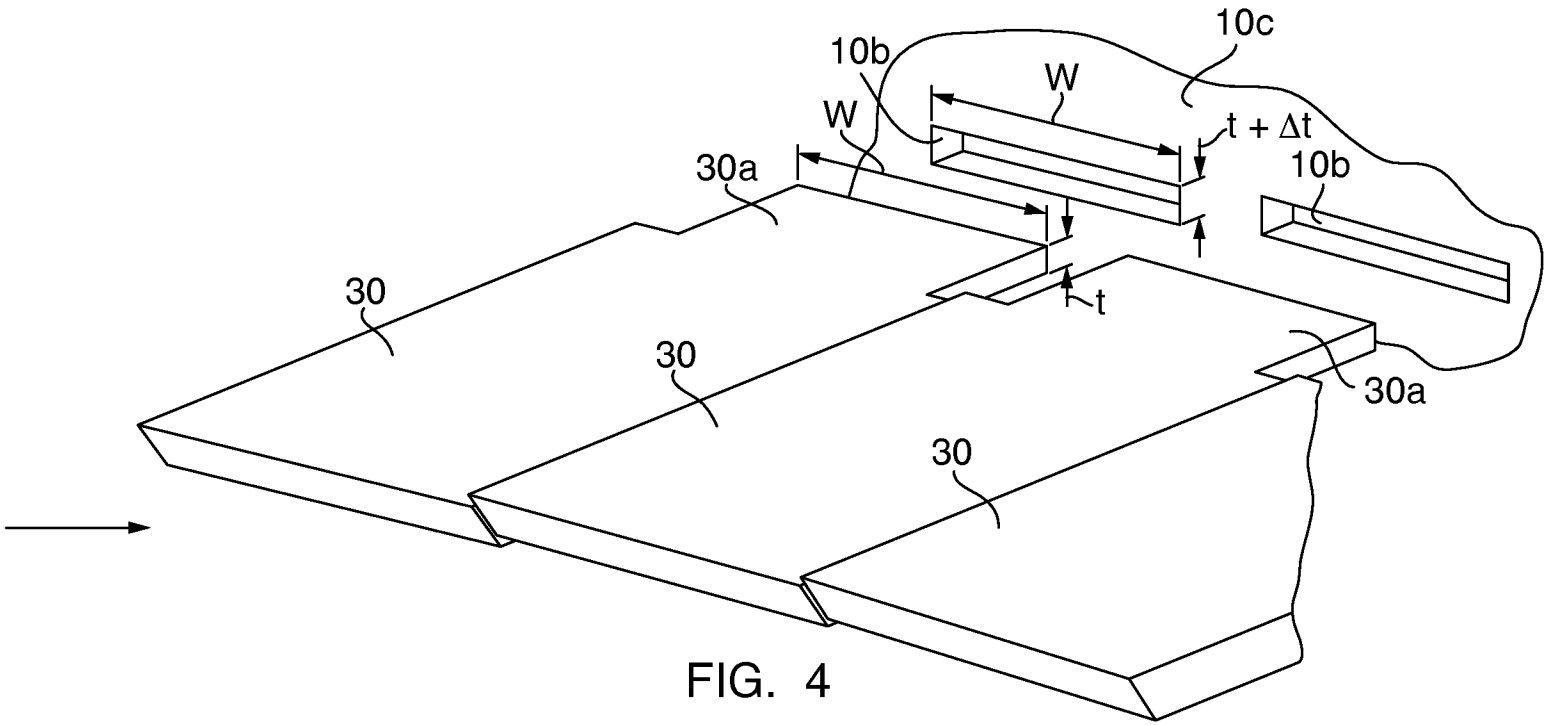
FIG. 4 is an exploded view showing in detail the relationship between the size of the vane end portions and that of the vane openings which loosely mount these vane end portion.
Figure 5A:
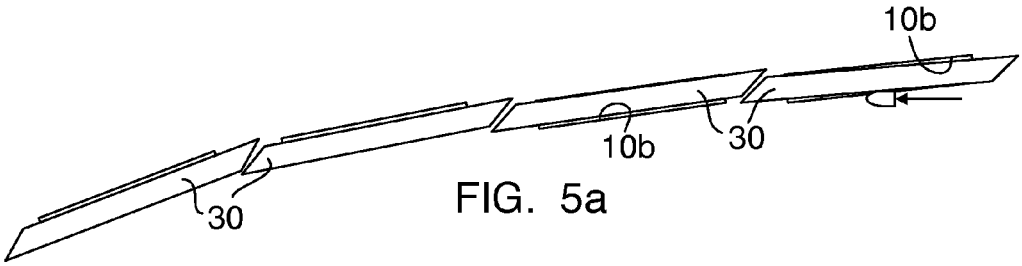
FIGS. 5*a*, 5*b*, 5*c*, and 5*d* show schematically, and sequentially, how the vanes are successively displaced by a bullet striking each vane in turn, during deceleration thereof in the containment chamber.
Figure 5B:
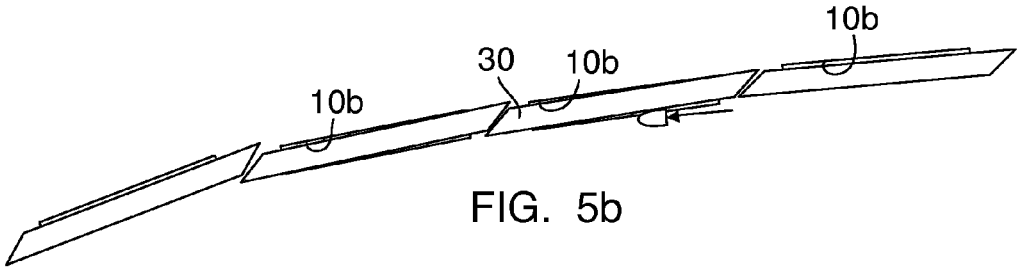
Figure 5C:
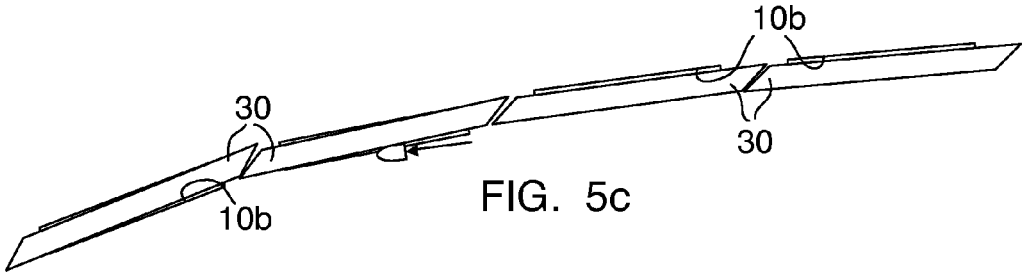
Figure 5D:
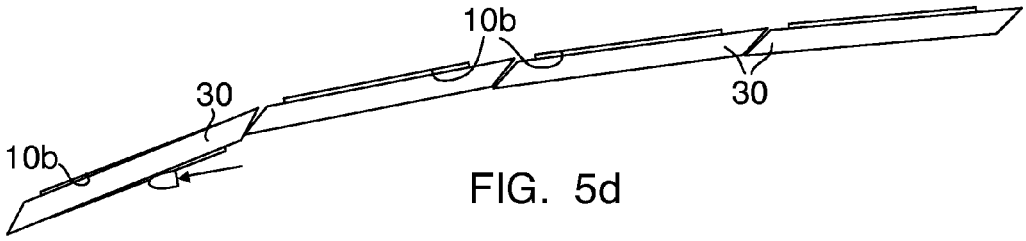
Figure 6:
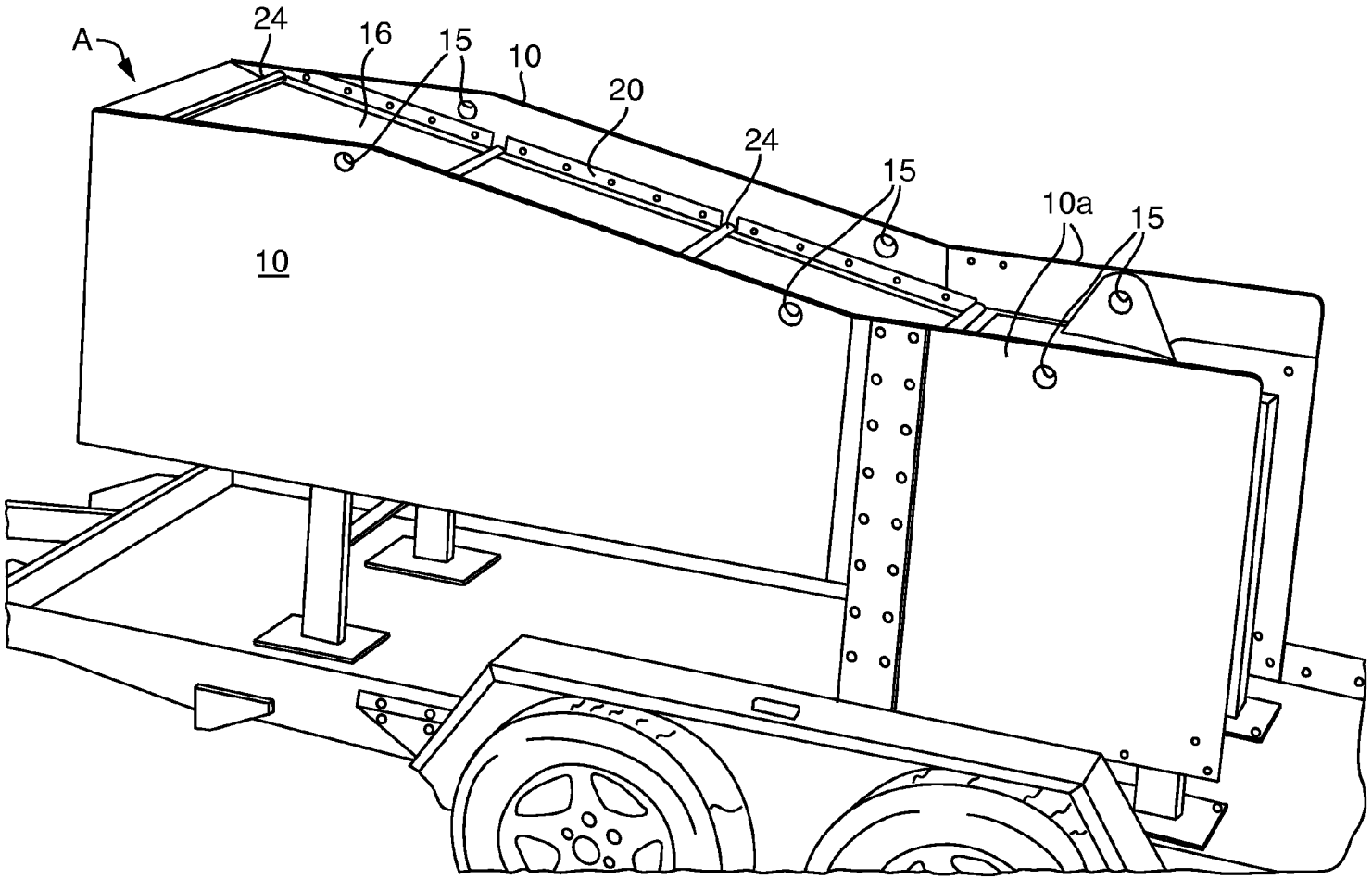
FIG. 6 shows a prototype of the bullet trap on a trailer, and illustrates the relative size of the prototype bullet trap.

The lower portion of the cylindrical chamber C has an outlet opening to facilitate collection of the projectiles and debris created by their controlled deceleration. A sub chamber F is provided at the lower region of the containment chamber, where the projectile debris can be safely removed following deceleration in the containment chamber C. Thus, the containment chamber C decelerates the projectiles in a unique manner, that also reduces the noise generated upon impact between the projectiles entering the open end D, and dropping through the outlet into the collection box F. The preferred chamber structure for achieving this deceleration is depicted in FIGS. 3,4 and 5.

Figure 3A:
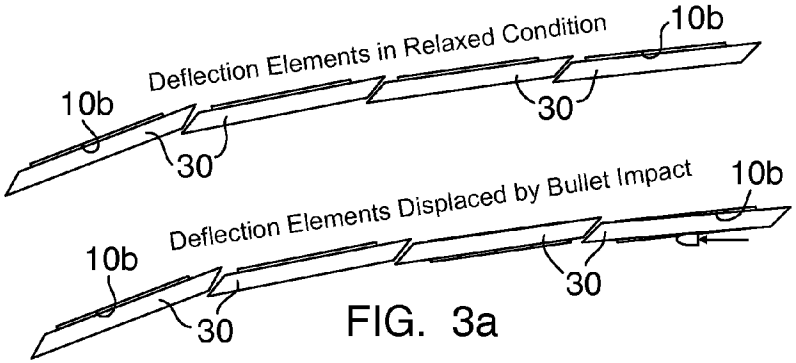
FIG. 3*a* shows in greater detail, several vanes of the impact area of the containment chamber in both relaxed condition, and also shows the same vanes as deflected by a bullet striking an upstream vane.

The chamber C is further defined by a plurality of parallel vanes 30,30 which extend across and between the fixed chamber side walls, 10*c*, 10*c*, which are extensions of the vertical steel plates 10,10. Each vane has projecting end portions in the form of tabs that are loosely received in vane openings 10*b*, 10*b* as best shown in FIG. 4. The width of these vane openings corresponds closely to that of the tabs However, the thickness of the tabs/vanes is slightly less than the corresponding dimension of the vane openings in the plates 10*c*, 10*c*, allowing the vanes 30, 30 to move radially inwardly or outwardly in these oversize vane openings. FIG. 3*a* shows how the vanes move in the process of decelerating a projectile or bullet striking any one of the vanes. Any vane in the path of a projectile entering the chamber from the transition passageway will be displaced angularly, and will slow the projectile and turn it slightly radially inwardly. Each vane has beveled edges engaging the edges of adjacent vanes so that at least two adjacent vanes will move in concert, as suggested schematically in FIGS. 3 and 4.

Vane movement is thus restricted in three ways, first by the vane opening size and shape described previously, and secondly by the beveled edges themselves, which cause the vane immediately downstream of that struck by a projectile to be displaced in an opposite angular sense from the vane actually struck by the projectile.

The third factor effecting vane movement is the compressible elastomeric blanket 40 provided around the outside of the vanes. The blanket exerts a radially inwardly directed biasing force on these vanes, because one or more tensionable straps or bands 42 are provided around the elastomeric blanket 40 to create a radially inwardly directed biasing force in the preferred embodiment shown. See 11,11 at the bottom of the containment chamber in FIG. 3 for one way in which to tension these straps. Strap tensioning means could also be provided at the midpoints for these straps, in a more convenient location if desired.

The adjacent vanes are thus held in edge to edge contact with one another and biased inwardly of their respective slots as suggested in FIG. 3 (top balloon view). When a vane is struck by a projectile, it twists slightly (as suggested at the lower view of the FIG. 3 balloon). This will decelerate the projectile. However, additional projectile deceleration will occur because of the aforementioned vane edge interaction. FIG. 5 shows the vane downstream of that vane actually struck, moving even without itself being struck by the projectile, and in an opposite angular direction. As the projectile continues on, it displaces succeeding vanes and FIG. 4 is an attempt to show this action in a series of sequential views, schematically showing how the projectiles are decelerated in an efficient manner.

In summary, adjacent turning vanes 30,30 have interacting trailing and leading edges, such that the trailing edge of an upstream vane lies inside the leading edge of a downstream vane. Thus, the vanes are normally biased inwardly, but adjacent vanes will be angularly displaced (oppositely) upon impact by a projectile at even slight angles of attack with the upstream vane. Stated somewhat differently, the vane leading edges define an arc of larger radius than the arc defined by the trailing edges, at least when the vanes are in normal or relaxed positions.

In the transitional passageway, between the containment entry and the main passageway throat, the upper boundary thereof is defined by vanes of the same design, restrained by biasing means of similar characteristics. This transition boundary can be seen to present only a slight angle of attack to projectiles entering the passageway, effectively decelerating projectiles gradually and even before they enter the chamber C, rather than abruptly deflecting the projectiles in a manner typical of prior art bullet traps.

Indeed, the number of vanes utilized in the semicircular or semi cylindrical impact area or zone of the containment chamber is such that a relationship exists between the number of vanes in this zone and the angular differential between adjacent vanes. Assuming that the angular differential be no more than 12 or 13 degrees, as in the preferred embodiment shown, the number of vanes in the semi circle defined by the chamber C must be on the order of 180 degrees/12=15 vanes. Such a relationship assures that no angle of projectile impact with a vane shall exceed 12 degrees. This is an important consideration as hardened steel, such as AR 500 cannot tolerate repeated projectile impacts greater than about 15 degrees.

In the preferred embodiment shown, all impact angles within the containment chamber are of 12 degrees or less. Furthermore, in the transition zone, between the throat area and the chamber opening, the vanes defining the upper impact boundary of the transition passageway can be seen to be oriented at even smaller incidence angles and are angled relative to one another at less than 2 or 3 degrees. Thus, the number of vanes in this transition zone, is increased as a result of reducing the angular differential between adjacent vanes to 2 or 3 degrees. In the preferred embodiment therefore, 5 or 6 vanes are arranged at these angular relationship (2-3 degrees) resulting in a total transitional zone range of between 10 and 18 degrees. The preferred range of turning in this transition zone being on the order of less than 12 degrees total, at least assuming the same size and shape for the vanes in both the chamber and the transition zone.

What is claimed is:

1. A projectile containment system for a firing range, comprising;

a) at least two opposing hardened steel plates defining a convergent passageway for guiding projectiles downstream into a throat area defined between the downstream ends of said opposing plates, and a frame having side plates defining openings that support laterally projecting tabs on said opposing plates, b) a generally cylindrical containment chamber communicating with said convergent passageway and defined by laterally extending projectile turning vanes that collectively define an arcuately shaped impact boundary of said containment chamber, said turning vanes having laterally opposed end portions that fit loosely into vane openings defined by said frame, c) vane biasing means acting upon said projectile turning vanes to urge the vanes inwardly of said containment chamber, said vanes serving to absorb the impact of projectiles impinging thereupon by displacement outwardly against the bias from said vane biasing means from the projectiles impinging thereupon.

2. The containment system of claim 1 wherein said vane biasing means comprises at least one tensioned band wrapped around at least a portion of said impact boundary of said containment chamber, and a compressible elastomeric blanket provided between said vanes and said tensioned band to urge said vanes inwardly.

3. The containment system of claim 1 wherein adjacent vanes of said impact boundary have interacting trailing and leading edges such that the trailing edge of an upstream vane lies inside the leading edge of an adjacent downstream vane when said vanes are in normal positions as determined by said vane biasing means.

4. The containment system of claim 3 wherein said interacting adjacent vane edges are so arranged that the leading edges define an arc of larger radius than the arc defined by said trailing edges when said vanes are in said normal positions.

5. The containment system of claim 1 further characterized by a transition passageway between said throat area and said containment chamber, said transition passageway having a transition boundary defined by projectile impact absorbing vanes said transition boundary vanes defining an impact absorbing continuation of said impact boundary of said containment chamber and means biasing said transition vanes inwardly.

6. The containment system of claim 5 wherein adjacent vanes of said impact boundaries have interacting adjacent trailing and leading edges such that the trailing edge of an upstream vane lies radially inside the leading edge of an adjacent downstream vane when said vanes are in normal positions as determined said vane biasing means.

7. The containment system of claim 6 wherein said interacting adjacent vane edges are so arranged that the leading edges define an arc of greater radius than that defined by said trailing edges when said vanes are in said normal positions.

8. The containment system of claim 1 wherein said vane openings restrict movement of said vanes to radial motion as a result of the relationship between said vane opening sizes and said vane end portions fitted into said vane openings.

9. The containment system of claim 3 wherein said vane openings restrict movement of said vanes to radial motion as a result of the relationship between said vane opening sizes and said vane end portions fitted into said vane openings.

10. The containment system of claim 9 wherein said interacting adjacent vane edges are so arranged that the leading edges define an arc of larger radius than the arc defined by said trailing edges when said vanes are in said normal positions.

11. The containment system of claim 10 further characterized by a transition passageway between said throat area and said containment chamber, said transition passageway having a transition boundary defined by projectile impact absorbing vanes said upper transition boundary vanes defining an impact absorbing continuation of said impact boundary of said containment chamber and means biasing said transition vanes inwardly.

12. The containment system of claim 11 wherein adjacent vanes of said transition passageway have interacting adjacent trailing and leading edges such that the trailing edge of an upstream vane lies radially inside the leading edge of an adjacent downstream vane when said vanes are in normal positions as determined said vane biasing means.

13. The containment system of claim 12 wherein said interacting adjacent vane edges of said transition boundary are so arranged that the leading edges define an arc of greater radius than that defined by said trailing edges when said vanes are in said normal positions.

14. The containment system of claim 1 wherein each vane has the cross-sectional shape of a parallelogram, and end portions fitted loosely into said vane openings, allowing limited tilting motion of the vanes in said openings.

15. The containment system of claim 1 wherein each vane has marginal edges complementary in shape to each adjacent marginal edge of an adjacent vane, whereby tilting movement of one vane causes tilting movement of that adjacent vane.

16. The containment system of claim 1 further characterized by said hardened steel plates defining said convergent passageway being loosely mounted in said side plate openings, and elastomeric pads provided between said inclined plates and said frame.

17. The containment system of claim 16 wherein said vane biasing means comprises at least one tensioned band wrapped around at least a portion of said impact boundary of said containment chamber, and a compressible elastomeric blanket provided between said vanes and said tensioned band to urge said vanes inwardly.

18. The containment system of claim 16 wherein adjacent vanes of said impact boundary have interacting trailing and leading edges such that the trailing edge of an upstream vane lies inside the leading edge of an adjacent downstream vane when said vanes are in normal positions as determined by said vane biasing means.

19. The containment system of claim 18 wherein said interacting adjacent vane edges are so arranged that the leading edges define an arc of larger radius than the arc defined by said trailing edges when said vanes are in said normal positions.

20. The containment system of claim 16 further characterized by a transition passageway between said throat area and said containment chamber, said transition passageway having a transition boundary defined by projectile impact absorbing vanes said upper transition boundary vanes defining an impact absorbing continuation of said impact boundary of said containment chamber and means biasing said transition vanes.

21. The containment system of claim 20 wherein adjacent vanes of said transition passageway have interacting adjacent trailing and leading edges such that the trailing edge of an upstream vane lies radially inside the leading edge of an adjacent downstream vane when said vanes are in normal positions as determined said vane biasing means.

22. The containment system of claim 21 wherein said interacting transition passageway adjacent vane edges are so arranged that the leading edges define an arc of greater radius than that defined by said trailing edges when said vanes are in said normal positions.

23. The containment system of claim 16 wherein said vane openings restrict movement of said vanes to radial motion as a result of the relationship between said vane opening sizes and said vane end portions fitted into said vane openings.

24. The containment system of claim 23 wherein said interacting adjacent vane edges are so arranged that the leading edges define an arc of larger radius than the arc defined by said trailing edges when said vanes are in said normal positions.

25. The containment system of claim 16 wherein each vane has marginal edges complementary in shape to each adjacent marginal edge of an adjacent vane, whereby tilting movement of one vane causes tilting movement of that adjacent vane.

* * * * *